US007499065B2

(12) United States Patent
Richards

(10) Patent No.: US 7,499,065 B2
(45) Date of Patent: Mar. 3, 2009

(54) ASYMMETRICAL SWITCHING DELAY COMPENSATION IN DISPLAY SYSTEMS

(75) Inventor: Peter Richards, San Francisco, CA (US)

(73) Assignee: Texas Instruments Incorporated, Dallas, TX (US)

( * ) Notice: Subject to any disclaimer, the term of this patent is extended or adjusted under 35 U.S.C. 154(b) by 972 days.

(21) Appl. No.: 10/865,993

(22) Filed: Jun. 11, 2004

(65) Prior Publication Data

US 2005/0275643 A1 Dec. 15, 2005

(51) Int. Cl.
*G09G 5/02* (2006.01)
*G09G 3/34* (2006.01)

(52) U.S. Cl. ..... 345/693; 345/84

(58) Field of Classification Search ..... 345/690–693, 345/84–86

See application file for complete search history.

(56) References Cited

U.S. PATENT DOCUMENTS 4,367,924 A 1/1983 Clark et al.
4,566,935 A 1/1986 Hornbeck
5,083,857 A 1/1992 Hornbeck
5,192,946 A 3/1993 Thompson et al.
5,254,980 A 10/1993 Hendrix et al.
5,278,652 A 1/1994 Urbanus et al.
5,287,096 A 2/1994 Thompson et al.
5,311,360 A 5/1994 Bloom et al.
5,339,090 A 8/1994 Crossland et al.
5,339,116 A 8/1994 Urbanus et al.
5,371,543 A 12/1994 Anderson
5,448,314 A 9/1995 Heimbuch et al.
5,497,172 A 3/1996 Doherty et al.
5,528,317 A 6/1996 Gove et al.
5,619,228 A 4/1997 Doherty
5,671,083 A 9/1997 Conner et al.
5,673,060 A 9/1997 Blaxtan et al.
5,731,802 A 3/1998 Aras et al.
5,745,193 A 4/1998 Urbanus et al.
5,751,379 A 5/1998 Markandey et al.
5,767,828 A 6/1998 McKnight
5,798,743 A 8/1998 Bloom
5,835,256 A 11/1998 Huibers
5,859,598 A 1/1999 Wade
5,969,710 A 10/1999 Doherty et al.
5,977,940 A 11/1999 Akiyama et al.
6,046,840 A 4/2000 Huibers
6,064,404 A 5/2000 Aras et al.
6,104,368 A 8/2000 Bonnett et al.
6,107,980 A 8/2000 Hermanns et al.

(Continued)

OTHER PUBLICATIONS

M. Bohm, et al., High Dynamic Range Image Sensors in Thin Film on ASIC Technology for Automatic Applications, pp. 157-172, 1998.

*Primary Examiner*—Bipin Shalwala
*Assistant Examiner*—Steven E Holton
(74) *Attorney, Agent, or Firm*—Wade James Brady, III; Frederick J. Telecky, Jr.

(57) ABSTRACT

A method and apparatus of the present invention is particularly for use in display systems having spatial light modulators in which the pixels present asymmetrical switching delays. For a desired illumination intensity of a pixel, a series of pulse-width-modulation bit values for the pixel is determined based at least in part upon a parameter that characterizes the asymmetrical transition behavior of the pixel between states.

57 Claims, 5 Drawing Sheets

U.S. PATENT DOCUMENTS 6,175,355 B1 1/2001 Reddy
6,225,991 B1 5/2001 McKnight
6,226,054 B1 5/2001 Morgan et al.
6,388,661 B1 5/2002 Richards
6,678,002 B2 1/2004 Frink et al.
6,930,692 B1 * 8/2005 Coker et al. ..... 345/690
7,113,195 B2 * 9/2006 Willis et al. ..... 345/691

* cited by examiner

ASYMMETRICAL SWITCHING DELAY COMPENSATION IN DISPLAY SYSTEMS

TECHNICAL FIELD OF THE INVENTION

The present invention relates to the art of display systems employing pulse-width-modulation techniques, and more particularly to operating display pixels having asymmetrical switching delays so as to compensate such delays.

BACKGROUND OF THE INVENTION

In current display systems employing pulse-width-modulation techniques, such as OLEDs, LCDs, plasmas, micromirror-based display systems and the like, the pixels of the display systems often exhibit asymmetrical switching delays in response to their driving forces. Such switching delays may arise from electromechanical responses of the pixels to the driving forces and optical responses of the components of the system to the driving forces. As a consequence, image quality is deteriorated.

As an example, in a micromirror-based display system, each pixel is a micromirror having a deflectable reflective mirror plate. The mirror plate rotates in response to an electrostatic force to different angles in opposite rotational directions. The ON and OFF operating states of the micromirror are defined based on the rotation angles. In the ON state, the mirror plate rotates to an ON state angle so as to generate a "bright" image pixel on a display target, whereas the mirror plate rotates to an OFF state angle so as to generate a "dark" image pixel on the display target.

Grayscale images can be created by turning the micromirror on and off at a rate faster than the human eye can perceive, such that the pixel appears to have an intermediate intensity proportional to the fraction of the time when the micromirror is on. This method is generally referred to as pulse-width-modulation (PWM). Full-color images may be created by using the PWM method on separate SLMs for each primary color, or by a single SLM using a field-sequential color method.

For addressing and turning the micromirror on or off, each micromirror may be associated with a memory cell circuit that stores a bit of data that determines the ON or OFF state of the micromirror. Specifically, the stored bit determines the magnitude of the electrostatic field between the mirror plate of the micromirror and the associated electrode. In order to achieve various levels of perceived light intensity by human eyes using PWM, the intensity level of each pixel of a grayscale image is represented by a plurality of data bits. Each data bit is assigned a significance. Each time the micromirror is addressed, the value of the written data bit determines whether the addressed micromirror turns on or off. Each bit's significance determines the duration of the micromirror's subsequent on or off period according to the addressing pattern. The bits of the same significance from all pixels of the image are called a bitplane. If the elapsed time the micromirrors are left in the state corresponding to each bitplane is proportional to the relative bitplane significance, the micromirrors produce the desired grayscale image.

This type of operation mechanism certainly favors prompt response of the micromirror to the electrostatic fields applied thereto. Ideally, the responses to the ON state and OFF state are symmetrical. In other words, the transition time of the micromirror from the ON state to the OFF state should be the same as the transition time from the OFF state to the ON state. Otherwise, the micromirror may not be able to accurately reproduce the desired grayscale. However, many real systems do exhibit asymmetry in the ON-to-OFF and OFF-to-ON switching times. When the micromirror has different transition time intervals for the ON and OFF state, the actual duration of the micromirror's optical on or off period is not the same as determined by the bits of the PWM. The actual grayscale produced by the micromirror deviates from the desired value.

Therefore, what is desired is a method of operating the pixels of a display system such that these asymmetrical switching delays may be compensated and an accurate grayscale level reproduced for the viewer.

SUMMARY OF THE INVENTION

The objects and advantages of the present invention will be obvious, and in part appear hereafter and are accomplished by the present invention that provides a method and apparatus for operating pixels of spatial light modulators in display systems. Such objects of the invention are achieved in the features of the independent claims attached hereto. Preferred embodiments are characterized in the dependent claims. In the claims, only elements denoted by the words "means for" are intended to be interpreted as means plus function claims under 35 U.S.C. §112, the sixth paragraph.

BRIEF DESCRIPTION OF DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF EXEMPLARY EMBODIMENTS

Figure 1:
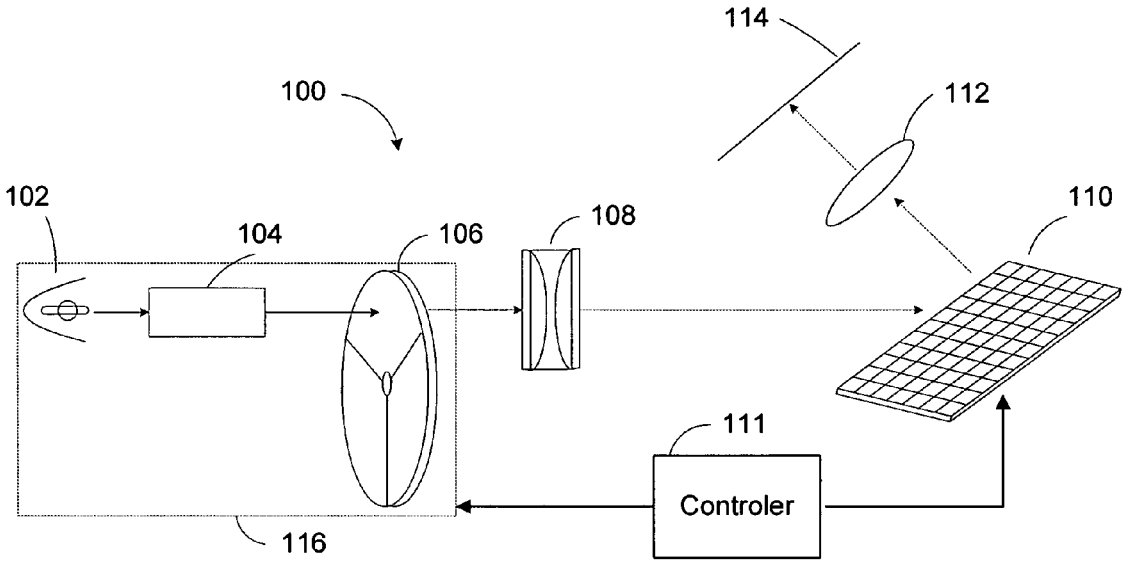
FIG. 1 illustrates an exemplary display system in which embodiments of the current invention can be implemented.

The present invention is used in display systems employing pulse-width-modulation and having pixels exhibiting asymmetrical switching delays in response to driving forces.

In an embodiment of the invention, a method of operating an array of pixels to generate an image using a pulse-width-modulation (PWM) technique, wherein each pixel has an asymmetric switching delay between an ON and OFF state is disclosed. The method comprises: assigning a set of nominal weights to a set of bits corresponding to the PWM pattern of a pixel; providing a desired intensity value to be reproduced by the pixel; determining the values of a first subset of bits according to the desired intensity such that the bits in the first set collectively present an intensity that approximates the desired intensity value; determining a residual intensity value based on the desired intensity value, the determined values of the first subset of bits and their corresponding nominal weights, and a parameter that characterizes the asymmetry of the pixel switching delay; determining the values of a second subset of bits depending on the residual intensity value, the parameter characterizing the asymmetry of the switching delay, the values and weights of the first subset of bits, and a dither threshold value; and operating the pixels with the PWM technique according to the determined bit values of the first and second subsets.

In another embodiment of the invention, a device for controlling the operation of an array of pixels to generate an image using a pulse-width-modulation (PWM) technique, wherein each pixel has an asymmetric switching delay between an ON and OFF state is provided. The device comprises: a set of data bits corresponding to a PWM pattern of a pixel with the data bits assigned with a set of nominal weights; a means for determining a value for each bit of a first subset of the data bits according to a desired intensity such that the bits in the first subset collectively present an intensity that approximates the desired intensity value; a means for determining a residual intensity value based on the desired intensity value, the determined values of the first subset of bits and their corresponding nominal weights, and a parameter that characterizes the asymmetry of the pixel switching delay; a means for determining the values of a second subset of bits depending on the residual intensity value, the parameter characterizing the asymmetry of the switching delay, the values and weights of the first subset of bits, and a dither threshold value; and a means for operating the pixels with the PWM technique according to the determined bit values of the first and second subsets.

In yet another embodiment of the invention, a projection system for displaying an image using a pulse-width-modulation (PWM) technique is provided. The device comprises: an illumination system providing light for the system; an array of pixels, each of which operates between an ON state and an OFF state for modulating light from the light source into different spatial directions, and wherein each pixel has an asymmetrical switching delay between an ON state and an OFF state; a controller that controls an operation of the pixel array and the illumination system, further comprising: a set of data bits corresponding to a PWM pattern of a pixel with the data bits assigned with a set of nominal weights; a means for determining a value for each bit of a first subset of the data bits according to a desired intensity such that the bits in the first subset collectively present an intensity that approximates the desired intensity value; a means for determining a residual intensity value based on the desired intensity value, the determined values of the first subset of bits and their corresponding nominal weights, and a parameter that characterizes the asymmetry of the pixel switching delay; a means for determining the values of a second subset of bits depending on the residual intensity value, the parameter characterizing the asymmetry of the switching delay, the values and weights of the first subset of bits, and a dither threshold value; and a means for operating the pixels with the PWM technique according to the determined bit values of the first and second subsets; and a projection lens for collecting the modulated light and projecting the modulated light onto a display target.

In the following, the present invention will be discussed in examples of display systems in which pixels of the display system are micromirrors. It will be understood that the following discussion is for demonstration purposes only, and it should not be interpreted in any ways as a limitation to the scope of the invention. For example, the method and apparatus of the present invention are also applicable to other type of display systems employing pulse-width-modulation, such as display systems having LCD, LCOS, plasma and OLED based spatial light modulators.

Turning to the drawings, FIG. 1 illustrates an exemplary display system in which embodiments of the invention can be implemented. In its basic configuration, display system 100 comprises illumination system 116, optical elements 108 and 112, spatial light modulator 110, controller 111, and display target 114.

The illumination system provides primary color light that are sequentially applied to the spatial light modulator. In an exemplary configuration, the illumination system light source 102, which can be an arc lamp, lightpipe 104 that can be any suitable integrator of light or light beam shape changer, and color filter 106, which can be a color wheel. In this particular configuration, the color wheel is positioned after the light source and lightpipe on the propagation path of the illumination light from the light source. Of course, other optical configurations can also be used, such as placing the color wheel between the light source and the lightpipe. Optical element 108, which can be a condensing lens, directs the primary color light onto the spatial light modulator in which the primary color light is reflected either into or away from projection lens 112 so as to generate a desired image pattern in the display target. The set of primary colors can comprise any set of three or more colors used to render the output image.

The modulation operation of the spatial light modulator, as well as the illumination systems is controlled by controller 111. For example, the controller synchronizes the loading of the bitplane image data of each primary color incident onto the spatial light modulator and the rotation of the color wheel.

Figure 2:
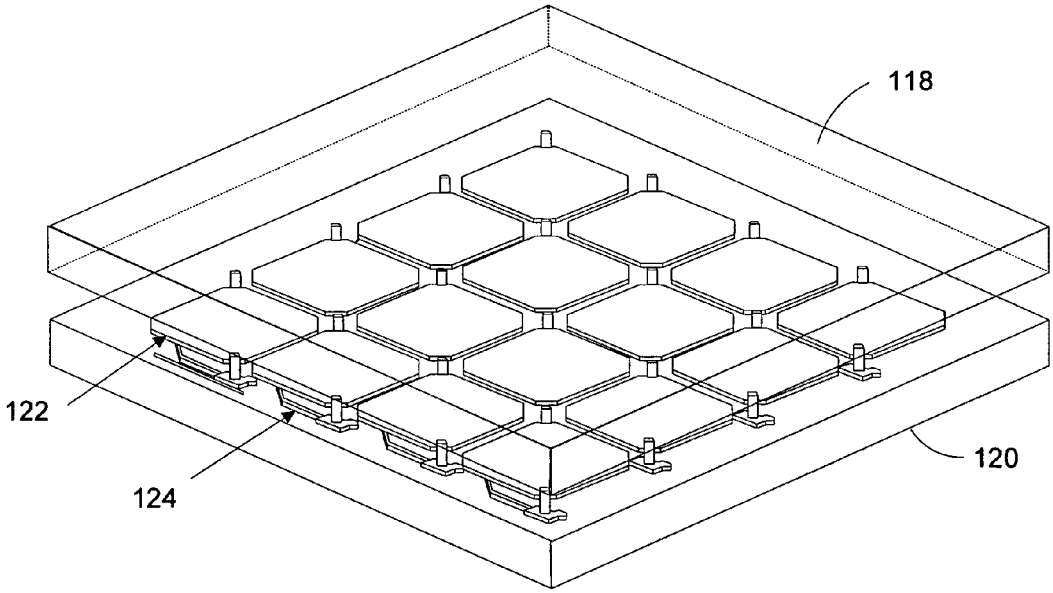
FIG. 2 is a perspective view of a portion of a spatial light modulator in FIG. 1.

FIG. 2 illustrates a portion of an exemplary spatial light modulator in FIG. 1. In this particular example, the spatial light modulator comprises an array of micromirrors 122 formed on substrate 118 that is light transmissive, such as glass. Each micromirror comprises a deflectable reflective mirror plate attached to a hinge such that the mirror plate can rotate relative to the light transmissive substrate. For improving the performance of the micromirrors, such as the contrast ratio of the displayed images, the mirror plate of the micromirror is attached to a hinge such that the mirror plate can rotate asymmetrically. Specifically, the mirror plate rotates to a larger angle in one direction than in an opposite direction. For further improving the contrast ratio of the displayed images, the hinge is formed "under" the mirror plate such that exposure of the hinge to the incident light is minimized. And the hinge is formed on a different plane parallel to the light transmissive substrate than the mirror plate. In another embodiment of the invention, the micromirror substrate can be formed on a transfer substrate that is light transmissive. Specifically, the micromirror plate can be formed on the transfer substrate and then the micromirror substrate along with the transfer substrate is attached to another substrate such as a light transmissive substrate followed by removal of the transfer substrate and patterning of the micromirror substrate to form the micromirror.

The rotation of the mirror plate is driven by an electrostatic force derived from an electrostatic field established between the mirror plate and an electrode (e.g. an electrode of electrode array 124) positioned proximate to the mirror plate. The electrode can be formed on a separate substrate 120 as shown in the figure. Alternatively, the mirror plate and the electrode can be formed on the same substrate, in which situation such a substrate can be a semiconductor wafer.

In operation, the micromirror switches between an ON and OFF state in response to an electrostatic field. In order to generate grayscale images, the micromirror is turned on and off at a rate faster than the human eye can perceive such that the pixel appears to have an intermediate intensity proportional to the fraction of the time when the micromirror is on. For this purposes, the voltages applied to the electrode, thus the strength of electrostatic field between the electrode and the mirror plate of the micromirror need to be switched between an ON state voltage and an OFF state voltage. With the ON state voltage, the electrostatic force applied to the mirror plate is able to drive the mirror plate to rotate to the ON state angle. The OFF state voltage can be zero (0) volt under which the mirror plate returns to the OFF state (e.g. a natural resting state) from the ON state. Alternatively, the OFF state voltage can be non-zero. In order to achieve various levels of perceived light intensity by human eyes using pulse-width-modulation, duration of the ON (or OFF) state voltage on the micromirror correspond to the significance of the date bit in which the ON (or OFF) state voltage is stored.

Figure 3A:
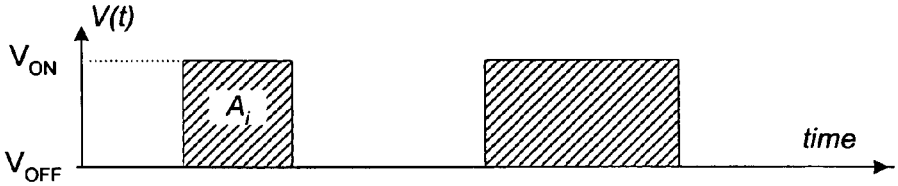
FIG. 3*a* illustrates a portion of a sequence of exemplary voltages on an electrode of the micromirror in FIG. 2 according to a desired PWM waveform.

As a way of example, FIG. 3*a* illustrates a portion of a sequence of voltages on the electrode associated with the micromirror. The voltage sequence is generated according to desired luminance intensity (grayscale). Specifically, the desired luminance intensity is proportional to the integrated of duration of the micromirror in the ON state, as illustrated by the shaded areas. The desired luminance intensity $I_0$ can be expressed as:

$$I_0 \propto \Sigma A_i = \int V(t)dt \qquad \text{Eq. 1}$$

wherein A(i) is the area of a $V_{ON}$ pulse; V(t) is the voltage applied to the electrode over time. However, the effective optical response of the micromirror exhibits asymmetrical switching delay in response to the applied electrostatic force, as shown in FIG. 3*b*.

Figure 3B:
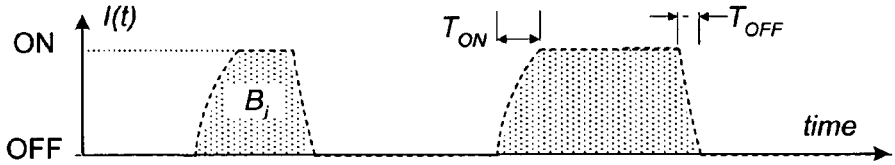
FIG. 3*b* illustrates responses of the micromirror in FIG. 2 to the voltages of the electrode in FIG. 3*a;*

Because the responses of the micromirror as shown in FIG. 3*b* is not coincident with the voltages on the electrode due to the asymmetrical switching delay, the actual luminance intensity generated by the micromirror represented by the integration of durations of the micromirror in the ON state does not equal the desired luminance intensity. The desired grayscale of the image will not be reproduced properly. The effective luminance intensity I can be expressed as:

$$I \propto \Sigma B_i = \int I(t)dt \qquad \text{(Eq. 3)},$$

$$\text{and } I \neq I_0$$

wherein I(t) is the intensity at time t and B(i) is the area of a illumination pulse. Referring to FIG. 3*b*, the response of the micromirror to the electrostatic fields derived from the sequence of voltages in the electrode as shown in FIG. 3*a* is illustrated therein. When the voltage in the electrode changes from the OFF state voltage to the ON state voltage, micromirror exhibits an ON state switching delay. When the voltage on the electrode drops from the ON state voltage to the OFF state voltage, the micromirror exhibits an OFF state switching delay. The ON state and OFF state switching delays are asymmetric, that is, they are different. While in reality these switching delays are 'ramps' taking a finite amount of time, the effective output waveform may be equivalently modeled by a series of ideal pulses with equivalent areas as shown in FIG. 3*c*. By offsetting the rising edges of V(t) by Ton, and offsetting the falling edges of V(t) by $T_{off}$, a waveform is obtained in which the pulses $C_i$ have areas equal to $B_i$. Thus the effect of the asymmetry of the switching delay may be expressed as: $B_i = A_i - \Delta$, wherein $$\Delta = T_{ON} - T_{OFF} \qquad \text{Eq. 2}$$

Figure 4:
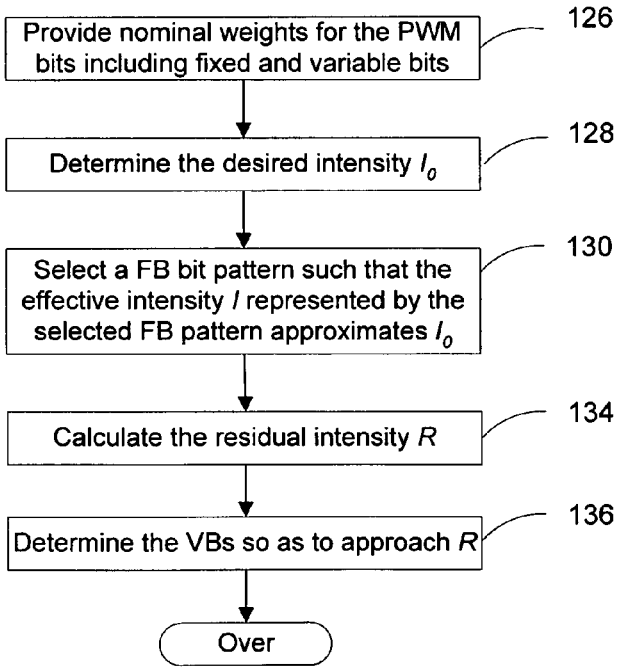
FIG. 4 is a flow chart showing the steps executed in operating the micromirrors so as to compensate the asymmetrical switching delay of the micromirror according to an embodiment of the invention.

In order to compensate for the effect asymmetrical switching delay as discussed above, a method of operating the micromirror is provided in the current invention. Additionally, in order to accurately render intensity levels between the discrete output levels of the device, a method of performing dithering is disclosed which takes this delay effect into account. The method can be implemented in many ways, one of which will be discussed with reference to FIG. 4. Referring to FIG. 4, a flow chart showing the steps executed in operating the micromirror with the asymmetrical switching delay compensated is illustrated therein.

According to an embodiment of the invention, a set of predetermined nominal weights is provided for the PWM bits including fixed and variable bits (step 126). Each nominal weight corresponds to the duration of a PWM bit duration in the displayed modulated image. For each pixel of the image, a desired intensity value is provided (step 128). For each pixel of the image, a set of output bits is to be calculated that will, when applied to the pixels according to a modulation sequence, accurately represent the desired intensity value. The set of outputs bits comprises a subset of 'fixed' bits and a subset of 'variable' bits.

Based on the desired intensity value and the nominal bit weights, a pattern of bit values is selected for the 'fixed' bits (step 130). The selection of the fixed-bit values may be performed in any suitable ways, for example the values of the fixed-bits may be dynamically calculated based on the nominal weights and the value of the switching delay parameter (using an algorithm such as the 'greedy algorithm' to select the bit values) or pre-computed values that are stored in a look-up table. The fixed-bit selection yields a pattern of the fixed-bits with a total effective weight (taking into account the delay effect) less than or equal to the target weight, but large enough such that one or more combinations of the variable bits (see below) provide the target weight when added together with the contribution from the fixed bits.

As a way of example, with the selected bit pattern for the fixed bits obtained at step 130, effective luminance intensity I is calculated with the asymmetrical switching delay of the micromirror being included. Specifically, all variable bits are set to 0 (zero). The weights of the fixed bits in the ON state are added up. The total switching delay $\Delta_{total}$ is calculated by $\Delta_{total} = \Delta \times$total number of switches (between the ON and OFF state) in the selected bit pattern of the fixed bits. The total switching delay is then subtracted from the summation of the weights of the ON state fixed bits, yielding the effective luminance intensity I. Because the effective luminance intensity is different from the desired luminance intensity $I_0$ with the asymmetrical switching delay included, the difference therebetween, which is referred to as residual luminance intensity R is approached using the variable bits.

Following the bit pattern selection for the fixed-bits, a residual intensity value is calculated. The residual value is equal to the difference between the desired intensity value and the effective intensity value contributed by the fixed bits, taking into account the delay effect.

In the embodiment of the invention, the nominal weight of the fixed bits is calculated by adding the weight of each individual bitplane for which the corresponding fixed bit is 1. The number of on/off transitions due to the fixed bits is then counted, and the number is multiplied by a value of the switching delay parameter, and product is then subtracted by the nominal weight to obtain an effective weight. These calculations can be performed by, for example a logic circuit. This effective weight is then subtracted from the desired intensity value to obtain the residual intensity value.

In an alternative embodiment of the invention, a lookup table stores, for each desired intensity value, an entry comprising an encoding for the fixed bits and a value for the residual intensity. The fixed-bit encoding and stored residual value are pre-computed to take into account the delay effect, as shown in FIG. 7.

Figure 7:
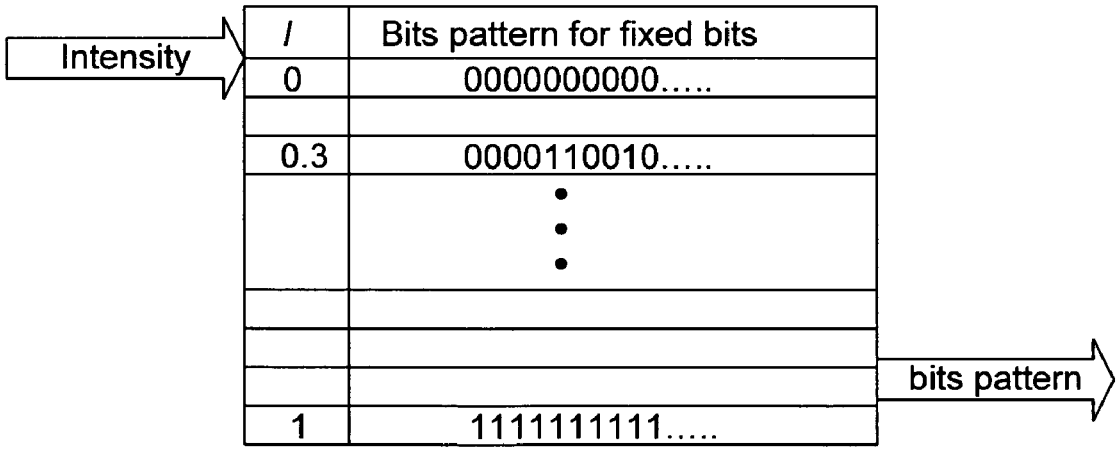
FIG. 7 demonstratively illustrates an exemplary look-up table used in performing the method of the present invention.

Referring to FIG. 7, the entries of the look-up table are bit patterns for the fixed bits, and the entries are indexed by luminance intensities (or grayscales) represented by the indexed entry. Given the input luminance intensity, the look-up table outputs a particular bit patter of the fixed bits such that the output bit pattern represents a luminance intensity that best approximates the input luminance intensity.

In a further alternative embodiment of the invention, a lookup table stores, for a subset of the intensity values, an entry comprising an encoding for the fixed bits an a value for the residual intensity. The difference between the desired intensity value and the intensity value used to index the table is added to the looked-up residual to obtain the final residual value to be used in the algorithm below. The fixed-bit encoding and stored residual value are pre-computed to take into account the delay effect.

Figures 8A, 8B, 8C, 8D, 8E:
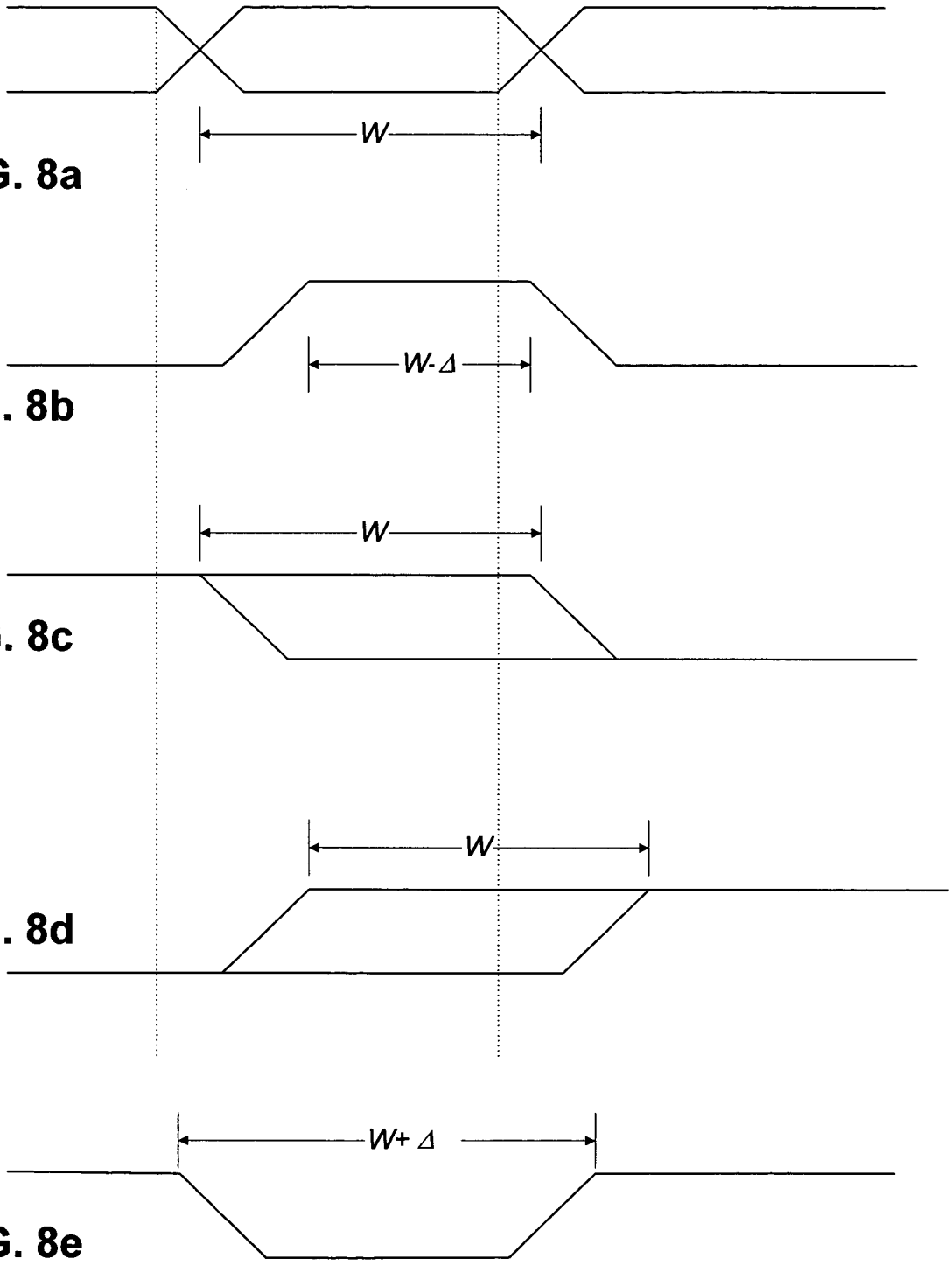
FIG. 8*a* demonstratively illustrate a sequence of voltages applied to a pixel of the spatial light modulator to achieve a desired grayscale.
FIGS. 8*b* to 8*e* demonstratively illustrate the effective responses of the pixel to the applied voltages in FIG. 8*a*.

In another embodiment of the invention, the residual value is used to choose a desired encoding of the remaining 'variable' data bits that closely approximate the intensity contribution of the residual value. The effective weights of the variable bits vary as a function of the already-chosen 'fixed' bits. For example, for a given desired weight of a bit as shown in FIG. 8*a,* the variable bit of nominal weight W might contribute only $W-\Delta$ if the bits preceding and following the bit are 0 as shown in FIG. 8*b;* or a weight of W if one, but not both, of the bits that precede and follow the bit are 1 as shown in FIGS. 8*c* and 8*d* respectively; or a weight of $W+\Delta$ if both preceding and following bits are 1, as shown in FIG. 8*e.* One embodiment of the invention performs a binary search through the set of variable bits, choosing one bit at a time until an encoding is found that results in an output value close to the residual. An alternative embodiment of the invention selects two encodings $V_0$ and $V_1$ of the variable bits, such that the effective intensities $R_0$ and $R_1$ of $V_0$ and $V_1$ respectively satisfy $R_0<=R<R_1$. A randomly or pseudo-randomly selected dither threshold value D is multiplied by $(R_1-R_0)$ to obtain a scaled dither threshold value E. The output variable-bit encoding $V_1$ is selected if $R-R_0>E$ otherwise the output encoding $V_0$ is selected for the variable bits. In this case, over many frames (and randomly selected values of D) the average output intensity will be exactly correct.

The residual luminance intensity R is calculated at step 132 by $R=I_0-I$. Based on the calculated R, the bit value of the variable bits are determined such that the luminance intensity represented by the variable bits approximates the residual luminance intensity R (step 136). There is a variety of ways of obtain the bit pattern for the variable bits. An exemplary method is illustrated in the flow chart in FIG. 5.

Figure 5:
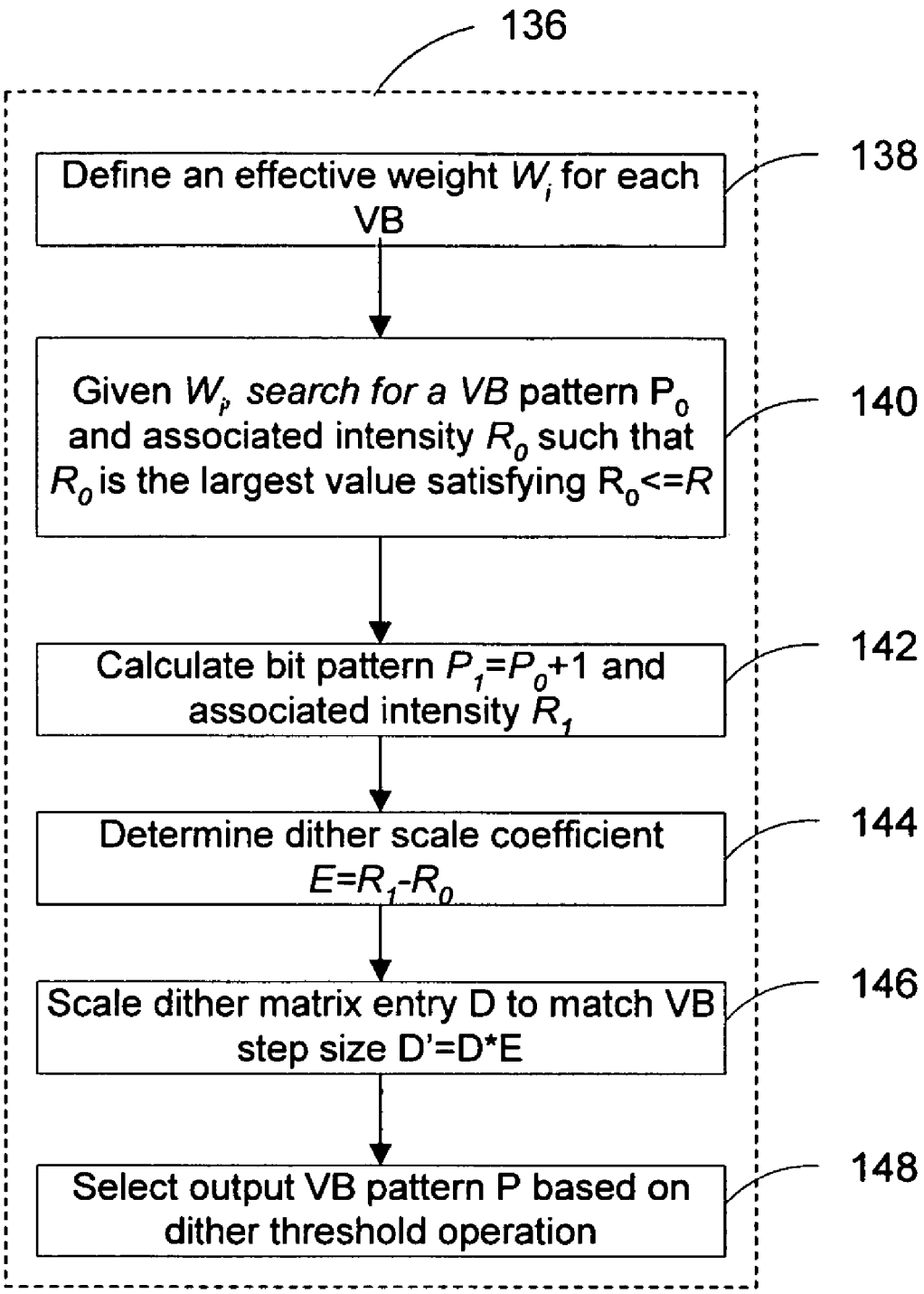
FIG. 5 is a flow chart showing the steps executed for determining the variable bits in FIG. 4.
Figure 6:
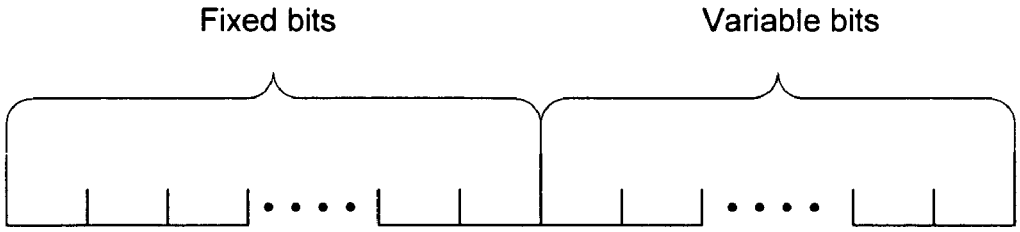
FIG. 6 illustrates a plurality of bits provided for representing the grayscales of a pixel of the spatial light modulator in FIG. 1.

Referring to FIG. 5, the determination of the variable bits in step 136 in FIG. 4 can be performed through steps 138 to 148 shown in FIG. 5. At step 138, a weighting scheme is selected for the variable bits. With weighting scheme, the weight of each variable bit $W_i$ is defined. As discussed before with reference to FIG. 6, the weighting scheme selected for the variable bits may or may not be the same as the fixed bits. And the selected weighting scheme can be binary, or any other desired weighting schemes. According to the embodiment of the invention, the variable bits are combined with the fixed bits with a redundant bit such that the carriers generated from the increments of the variable bits are suppressed within the variable bits without affecting the values of the fixed bits.

Given the weighting scheme and the weights $W_i$, a bit pattern is determined for the variable bits such that the luminance intensity $R_0$ represented by the variable bits of the selected bit pattern is the largest luminance intensity equal to or less than the residual luminance intensity R, that is $R>=R_0$ (step 140). In general, the calculated residual luminance intensity $R_0$ does not equal the target residual luminance intensity R. To best present the desired residual luminance intensity, the second bit pattern for the variable bits is investigated such that the second residual luminance intensity $R_1$ represented by the second bit pattern is adjacent to the residual luminance intensity $R_0$ (step 142). The second bit pattern is obtained by adding the first bit pattern by one (1), or by otherwise searching for the variable-bit pattern with the smallest total effective weight $R_1$ such that $R<R_1$. The two selected bit patterns of the variable bits are then dithered to obtain the desired intermediate residual luminance intensity R, which are performed in steps 144 to 146. Specifically, the dither scaling coefficient K is calculated from $E=R_1-R_0$ (step 144). The dither threshold matrix entry D is generated from a uniformly distributed random; or pseudorandom source, determining the density of dithered values that will be used to synthesize intensity levels between the discrete available output levels. D is then scaled based on the scale coefficient K by $E=D\times K$ (step 146). Based upon the scaled dither dither threshold, a bit pattern is then determined and output for the variable bits (step 148). For example, the output bit pattern for the variable bits is the first bit pattern representing the first residual luminance intensity $R_0$ if the difference between the desired residual luminance intensity R and $R_0$ is equal to or greater than the scaled dither matrix entry E. Otherwise, the second bit pattern is output and assigned to the variable bits, wherein the second bit pattern represents the second residual luminance intensity $R_1$.

The fixed and variable bits are each a assigned a corresponding significance. The weighting schemes for the fixed and variable bits may or may not be the same. And the weighting scheme can be binary, non-binary or any desired scheme. For example, the variable bits may comply with a binary weighting scheme such as 1, 2, 4, and 8 when 4 bits are used as variable bits, while the fixed bits comply with a non-binary weighting scheme, such as 12, 17, 19, 22, 25, 23, 27, and 31. When a non-binary weighting scheme is employed for the fixed bits, the gaps between adjacent fixed-bit patterns are preferably within a reasonable range such that the increment of the luminance intensities represented by the adjacent bit patterns is minimized, reducing the potential for visible 'contours' between levels. "A bit pattern" in the current application is referred to as a combination of bit values for the fixed and variable bits with each bit having a certain value, either 1 or 0.

Without the above-described fixed/variable bit method, there are two disadvantages. First, as the dithering is applied, the 'carry' generated when switching between adjacent levels might propagate into the larger-weighted bits. The temporal dithering between different encodings of the more-significant bits will result in greater visual flickering of the dithered pixels. Additionally, calculating such a carry value is complex to implement in an efficient way that is still independent of the potentially arbitrary weights of the more-significant bits. Finally, the interdependence of the bit weights caused by the delay effect may lead to a circular situation where a change in the more-significant bits requires some intermediate values to be recalculated. The fixed/variable algorithm described above avoids all of these problems. In order for the algorithm to work, the fixed-bit weights and encodings must be selected such that no 'gaps' in the set of encodings exist when the fixed-bit patterns are combined with all possible variable-bit patterns. This constraint can be pre-computed and checked 'offline' and need not be handled in the live video stream. As a way of example wherein the variable bits are binary weighted (e.g. 8, 4, 2, and 1), the variable bits can be combined with the fixed bits with a bit having weight of 15 instead of 16, as shown in Table 1. The incremented level by adding 1 to the variable bits will not affect the values of the fixed bits. As a result, the unsatisfactory dithering problem due to the increment carries can be avoided, and the image noise due to dithering can be minimized, which will be discussed in detail afterwards.

TABLE 1

| | Fixed bit | Var. bits | | | | Incremented var. bits for dither | | | |
|---|---|---|---|---|---|---|---|---|---|
| Level | 15 | 8 | 4 | 2 | 1 | 8 | 4 | 2 | 1 |
| 0 | 0 | 0 | 0 | 0 | 0 | 0 | 0 | 0 | 1 |
| 1 | 0 | 0 | 0 | 0 | 1 | 0 | 0 | 1 | 0 |
| 2 | 0 | 0 | 0 | 1 | 0 | 0 | 0 | 1 | 1 |
| 3 | 0 | 0 | 0 | 1 | 1 | 0 | 1 | 0 | 0 |
| 4 | 0 | 0 | 1 | 0 | 0 | 0 | 1 | 0 | 1 |
| | | | | ... | | | | | |
| 14 | 0 | 1 | 1 | 1 | 0 | 1 | 1 | 1 | 1 |
| 15 | 1 | 0 | 0 | 0 | 0 | 0 | 0 | 0 | 1 |
| 16 | 1 | 0 | 0 | 0 | 1 | 0 | 0 | 1 | 0 |

It can be seen from Table 1 that a redundant bit having weight of 15, rather than 16 is used to join the variable bits to the fixed bits. At level 14, for example, when the variable bits of weights 8, 4, 2, and 1 are all 1 (one), an increment to level 15 changes the value of the redundant bit without changing the values of the fixed bits. In contrast without a fixed redundant bit of weight 16, dithering between levels 15 and 16 would results in changes of the fixed bits.

Given the determined bits patterns for the fixed bits and variable bits, the desired grayscale of the image can be presented by the micromirror using known pulse-width-modulation methods.

The method of the current invention can be implemented in a device, such as controller 111. In particular, the embodiments of the present invention may be implemented using computer-executable instructions in a microprocessor or DSP, such as program modules. Generally, program modules include routines, objects, components, data structures and the like that perform particular tasks or implement particular abstract data types. The term "program" includes one or more program modules. When the embodiments of the present invention are implemented in such a unit, it is preferred that the unit communicates with the controller, takes corresponding actions to signals, such as actuation signals from the controller.

It will be appreciated by those of skill in the art that a new and useful method and a device for operating pixels exhibiting asymmetrical switching delays in display systems employing pulse-width-modulation have been described herein. In view of the many possible embodiments to which the principles of this invention may be applied, however, it should be recognized that the embodiments described herein with respect to the drawing figures are meant to be illustrative only and should not be taken as limiting the scope of invention. Those of skill in the art will recognize that the illustrated embodiments can be modified in arrangement and detail without departing from the spirit of the invention. Therefore, the invention as described herein contemplates all such embodiments as may come within the scope of the following claims and equivalents thereof.

I claim:

1. A method of operating an array of pixels to generate an image using a pulse-width-modulation (PWM) technique, wherein each pixel has an asymmetric switching delay between an ON and OFF state, the method comprising:

assigning a set of nominal weights to a set of bits corresponding to the PWM pattern of a pixel;

providing a desired intensity value to be reproduced by the pixel;

determining the values of a first subset of bits according to the desired intensity such that the bits in the first set collectively present an intensity that approximates the desired intensity value;

determining a residual intensity value based on the desired intensity value, the determined values of the first subset of bits and their corresponding nominal weights, and a parameter that characterizes the asymmetry of the pixel switching delay;

determining the values of a second subset of bits depending on the residual intensity value, the parameter characterizing the asymmetry of the switching delay, the values and weights of the first subset of bits, and a dither threshold value; and operating the pixels with the PWM technique according to the determined bit values of the first and second subsets.

2. The method of claim 1, wherein the pixel is a micromirror that comprises a reflective mirror plate that is operable to rotate into a plurality of different positions in response to an electrostatic field.

3. The method of claim 1, wherein the time difference between transitions are resulted from a difference between a response of the pixel to an external driving force from the ON state to the OFF state and a response of the pixel to another force from the OFF state to the ON state.

4. The method of claim 1, wherein the time difference is resulted from an operation of a set of optical elements of the display system.

5. The method of claim 1, wherein the pixel is a micromirror having a reflective deflectable mirror plate held on a substrate; and wherein the OFF state corresponds to the mirror plate at a position parallel to the substrate.

6. The method of claim 1, wherein the bits in the first and second subsets have different weighting schemes.

7. The method of claim 6, wherein the bits in the first subset comply with a binary weighting scheme.

8. The method of claim 6, wherein the bits in the first subset comply with a non-binary weighting scheme.

9. The method of claim 6, wherein the bits in the second subset comply with a binary weighting scheme.

10. The method of claim 6, wherein the bits in the second subset comply with a non-binary weighting scheme.

11. The method of claim 1, wherein the parameter that characterizes the switching delay is a difference between a transition time of the pixel from the OFF state to the ON state and a transition time of the pixel from the ON state to the OFF state.

12. The method of claim 11, wherein the step of determining the value for each bit in the first subset further comprises:

determining a value for each bit in the first subset such that the bits of the first subset collectively approximates the desired luminance intensity;

setting a value of each bit in the second subset to zero; and calculating the effective luminance intensity based on the determined bits of the first subset and the parameters characterizing the switching delay.

13. The method of claim 12, wherein the step of calculating the effective luminance intensity further comprises:

calculating the effective luminance by adding up the weights of the ON state bits in the first subset; and subtracting the effective luminance intensity by a production of a total number of transitions between the ON and Off state and the difference between the transitions intervals.

14. The method of claim 12, wherein the step of determining the value for each bit of the second subset further comprises:

defining an effective weight for each bit of the second subset so as to obtain a first bit pattern of the bits in the second subset; and determining a first effective residual luminance intensity according to the first bit pattern of the bits in the second subset such that the first effective residual luminance intensity approximates a residual luminance intensity that is a difference between the desired luminance intensity and the effective luminance intensity.

15. The method of claim 14, wherein the first effective residual luminance intensity is less than the residual luminance intensity.

16. The method of claim 14, further comprising:

calculating a second bit pattern of the bits in the second subset by adding the first bit pattern by 1 (one);

calculating a second effective residual luminance intensity from the second bit pattern of the bits in the second subset; and dithering the bits in the second subset between the first and second effective luminance intensities.

17. The method of claim 16, wherein the step of dithering the bits in the second subset group further comprises:

determining a dithering scaling coefficient that is a difference between the first and second effective residual luminance intensities; and scaling a dithering matrix entry to match a step size of the bits in the second subset; and determining an output bit pattern of the bits in the second subset based on a threshold criterion.

18. The method of claim 17, wherein the threshold criterion states that, the output bit pattern of the bits in the second subset is the first bit pattern when the difference between the effective residual luminance intensity is larger than the step size; and the output bit pattern of the bits in the second subset is the second bit pattern when the difference between the effective residual luminance intensity is smaller or equal to the step size.

19. The method of claim 1, further comprising:

determining a weighting scheme for the bits in each subset such that a carrier created in the second subset does not effect the values of the bits in the first subset.

20. A device for controlling the operation of an array of pixels to generate an image using a pulse-width-modulation (PWM) technique, wherein each pixel has an asymmetric switching delay between an ON and OFF state, the device comprising:

a set of data bits corresponding to a PWM pattern of a pixel with the data bits assigned with a set of nominal weights;

a means for determining a value for each bit of a first subset of the data bits according to a desired intensity such that the bits in the first subset collectively present an intensity that approximates the desired intensity value;

a means for determining a residual intensity value based on the desired intensity value, the determined values of the first subset of bits and their corresponding nominal weights, and a parameter that characterizes the asymmetry of the pixel switching delay;

a means for determining the values of a second subset of bits depending on the residual intensity value, the parameter characterizing the asymmetry of the switching delay, the values and weights of the first subset of bits, and a dither threshold value; and a means for operating the pixels with the PWM technique according to the determined bit values of the first and second subsets.

21. The device of claim 20, wherein the bits in the first and second subsets have different weighting schemes.

22. The device of claim 21, wherein the bits in the first subset comply with a binary weighting scheme.

23. The device of claim 21, wherein the bits in the first subset comply with a non-binary weighting scheme.

24. The device of claim 21, wherein the bits in the second subset comply with a binary weighting scheme.

25. The device of claim 21, wherein the bits in the second subset comply with a non-binary weighting scheme.

26. The device of claim 20, wherein the parameter that characterizes the switching delay is a difference between a transition time of the pixel from the OFF state to the ON state and a transition time of the pixel from the ON state to the OFF state.

27. The device of claim 26, wherein the means for determining the value for each bit in the first subset further comprises: a means for determining a value for each bit in the first subset such that the bits of the first subset collectively approximate the desired luminance intensity; a means for setting a value of each bit in the second subset to zero; and a means for calculating the effective luminance intensity based on the determined bits of the first subset and the parameters characterizing the switching delay.

28. The device of claim 27, wherein the means for calculating the effective luminance intensity further comprises:

a means for calculating the effective luminance by adding up the weights of the ON state bits in the first subset; and a means for subtracting the effective luminance intensity by a production of a total number of transitions between the ON and Off state and the difference between the transitions intervals.

29. The device of claim 27, wherein the means for determining the value for each bit of the second subset further comprises: a means for defining an effective weight for each bit of the second subset so as to obtain a first bit pattern of the bits in the second subset; and a means for determining a first effective residual luminance intensity according to the first bit pattern of the bits in the second subset such that the first effective residual luminance intensity approximates a residual luminance intensity that is a difference between the desired luminance intensity and the effective luminance intensity.

30. The device of claim 29, wherein the first effective residual luminance intensity is less than the residual luminance intensity.

31. The device of claim 29, further comprising:
a means for calculating a second bit pattern of the bits in the second subset by adding the first bit pattern by 1 (one);
a means for calculating a second effective residual luminance intensity from the second bit pattern of the bits in the second subset; and
a means for dithering the bits in the second subset between the first and second effective luminance intensities.

32. The device of claim 31, wherein the means for dithering the bits in the second subset further comprises:
a means for determining a dithering scaling coefficient that is a difference between the first and second effective residual luminance intensities; and
a means for scaling a dithering matrix entry to match a step size of the bits in the second subset; and
a means for determining an output bit pattern of the bits in the second subset based on a threshold criterion.

33. The device of claim 32, wherein the threshold criterion states that, the output bit pattern of the bits in the second subset is the first bit pattern when the difference between the effective residual luminance intensity is larger than the step size; and the output bit pattern of the bits in the second subset is the second bit pattern when the difference between the effective residual luminance intensity is smaller or equal to the step size.

34. The device of claim 20, further comprising: a means for determining a weighting scheme for the bits in each subset such that a carrier created in the second subset does not effect the values of the bits in the first subset.

35. A projection system for displaying an image using a pulse-width-modulation (PWM) technique, the device comprising:
an illumination system providing light for the system;
an array of pixels, each of which operates between an ON state and an OFF state for modulating light from the light source into different spatial directions, and wherein each pixel has an asymmetrical switching delay between an ON state and an OFF state;
a controller that controls an operation of the pixel array and the illumination system, further comprising:
a set of data bits corresponding to a PWM pattern of a pixel with the data bits assigned with a set of nominal weights;
a means for determining a value for each bit of a first subset of the data bits according to a desired intensity such that the bits in the first subset collectively present an intensity that approximates the desired intensity value;
a means for determining a residual intensity value based on the desired intensity value, the determined values of the first subset of bits and their corresponding nominal weights, and a parameter that characterizes the asymmetry of the pixel switching delay;
a means for determining the values of a second subset of bits depending on the residual intensity value, the parameter characterizing the asymmetry of the switching delay, the values and weights of the first subset of bits, and a dither threshold value; and
a means for operating the pixels with the PWM technique according to the determined bit values of the first and second subsets; and
a projection lens for collecting the modulated light and projecting the modulated light onto a display target.

36. The projection system of claim 35, wherein the bits in the first and second subsets have different weighting schemes.

37. The projection system of claim 36, wherein the bits in the first subset comply with a binary weighting scheme.

38. The projection system of claim 36, wherein the bits in the first subset comply with a non-binary weighting scheme.

39. The projection system of claim 36, wherein the bits in the second subset comply with a binary weighting scheme.

40. The projection system of claim 36, wherein the bits in the second subset comply with a non-binary weighting scheme.

41. The projection system of claim 35, wherein the parameter that characterizes the switching delay is a difference between a transition time of the pixel from the OFF state to the ON state and a transition time of the pixel from the ON state to the OFF state.

42. The projection system of claim 41, wherein the means for determining the value for each bit in the first subset comprises: a means for determining a value for each bit in the first subset such that the bits of the first subset collectively approximates the desired luminance intensity; a means for setting a value for each bit in the second subset to zero; and a means for calculating the effective luminance intensity based on determined bits of the first subset and the parameters characterizing the switching delay.

43. The projection system of claim 42, wherein the means for calculating the effective luminance intensity further comprises:
a means for calculating the effective luminance by adding up the weights of the ON state bits in the first subset; and
a means for subtracting the effective luminance intensity by a production of a total number of transitions between the ON and Off state and the difference between the transitions intervals.

44. The projection system of claim 42, wherein the means for determining the value for each bit of the second subset further comprises: a means for defining an effective weight for each bit of the second subset so as to obtain a first bit pattern of the bits in the second subset; and a means for determining a first effective residual luminance intensity according to the first bit pattern of the bits in the second subset such that the first effective residual luminance intensity approximates a residual luminance intensity that is a difference between the desired luminance intensity and the effective luminance intensity.

45. The projection system of claim 44, wherein the first effective residual luminance intensity is less than the residual luminance intensity.

46. The projection system of claim 44, further comprising:
a means for calculating a second bit pattern of the bits in the second subset by adding the first bit pattern by 1 (one);
a means for calculating a second effective residual luminance intensity from the second bit pattern of the bits in the second subset; and
a means for dithering the bits in the second subset between the first and second effective luminance intensities.

47. The projection system of claim 46, wherein the means for dithering the bits in the second subset further comprises:
a means for determining a dithering scaling coefficient that is a difference between the first and second effective residual luminance intensities; and
a means for scaling a dithering matrix entry to match a step size of the bits in the second subset; and
a means for determining an output bit pattern of the bits in the second subset based on a threshold criterion.

48. The projection system of claim 47, wherein the threshold criterion states that, the output bit pattern of the bits in the second subset is the first bit pattern when the difference between the effective residual luminance intensity is larger than the step size; and the output bit pattern of the bits in the second subset is the second bit pattern when the difference between the effective residual luminance intensity is smaller or equal to the step size.

49. The projection system of claim 35, further comprising: a means for determining a weighting scheme for the bits in each subset such that a carrier created in the second subset does not effect the values of the bits in the first subset.

50. The projection system of claim 35, wherein the illumination system comprises:

a light source providing white light;

a light pipe for directing the light from the light source onto the pixel array; and a color wheel.

51. The projection system of claim 35, wherein the pixel array is a micromirror array that comprises an array of micromirrors.

52. The projection system of claim 51, wherein each micromirror of the micromirror array comprises:

a substrate;

a hinge held on the substrate; and a reflective deflectable mirror plate attached to the hinge such that the mirror plate can rotate above the substrate.

53. The projection system of claim 52, wherein each micromirror comprises an ON state electrode and an OFF state electrode, wherein the ON state electrode drives the mirror plate to rotate towards the ON state, and the OFF state electrode drives the mirror plate to rotate towards the OFF state.

54. The projection system of claim 52, further comprising:

an electrode disposed at a location proximate to the mirror plate such than an electrostatic field can be established between the mirror plate and the electrode for rotating the mirror plate.

55. The projection system of claim 52, wherein the mirror plate and the hinge are formed on separate planes each of which parallel to the substrate.

56. The projection system of claim 54, wherein the electrode is formed on the substrate on which the hinge and the mirror plate are formed.

57. The projection system of claim 54, wherein the electrode is formed on a separate substrate than the substrate on which the mirror plate and the hinge are formed.

* * * * *